US005181571A

United States Patent [19]

Mueller et al.

[11] Patent Number: 5,181,571

[45] Date of Patent: * Jan. 26, 1993

[54] WELL CASING FLOTATION DEVICE AND METHOD

[75] Inventors: Mark D. Mueller, Santa Maria, Calif.; Frank L. Jones, Balikpapan, Indonesia; Julio M. Quintana, Bakersfield, Calif.; Kenneth E. Ruddy, Houston, Tex.; Michael G. Mims, Bakersfield, Calif.

[73] Assignee: Union Oil Company of California, Los Angeles, Calif.

[ * ] Notice: The portion of the term of this patent subsequent to Jan. 22, 2008 has been disclaimed.

[21] Appl. No.: 820,997

[22] Filed: Feb. 10, 1992

Related U.S. Application Data

[63] Continuation of Ser. No. 569,691, Aug. 22, 1990, which is a continuation-in-part of Ser. No. 401,086, Aug. 31, 1989, Pat. No. 4,986,361, and a continuation-in-part of Ser. No. 486,312, Feb. 28, 1990, abandoned, and a continuation-in-part of Ser. No. 560,389, Jul. 31, 1990, which is a continuation-in-part of Ser. No. 401,086, , and Ser. No. 486,312.

[51] Int. Cl.[5] ..... E21B 33/10

[52] U.S. Cl. ..... 166/381; 166/77; 166/386

[58] Field of Search ..... 166/380, 381, 386, 77, 166/191

[56] References Cited

U.S. PATENT DOCUMENTS

| | | | |
|---|---|---|---|
| 2,698,054 | 12/1954 | Brown et al. | 166/381 |
| 3,526,280 | 9/1990 | Aulick | 166/386 X |
| 4,308,917 | 1/1982 | Dismukes | 166/381 |
| 4,384,616 | 5/1983 | Delinger | 166/376 |
| 4,396,211 | 8/1983 | McStravick et al. | 285/47 |
| 4,484,641 | 11/1984 | Dismukes | 175/61 |
| 4,589,495 | 5/1986 | Langer et al. | 166/383 |
| 4,683,955 | 8/1987 | Stepp et al. | 166/327 |
| 4,986,361 | 1/1991 | Mueller et al. | 166/381 |

FOREIGN PATENT DOCUMENTS

| | | | |
|---|---|---|---|
| 0186317 | 7/1986 | European Pat. Off. . | |
| 3021558 | of 0000 | Fed. Rep. of Germany . | |
| 547526 | 5/1977 | U.S.S.R. | 166/386 |

OTHER PUBLICATIONS

"Mobil Identifies Extended-Reach-Drilling Advantages, Possibilities in North Sea" by Tolle et al., Presentation of Offshore Northern Seas Conf., 1985.

"Extended Reach Drilling From Platform Irene", by Mueller et al., OTC #6224, Presented at 22nd Annual Offshore Technology Conference, May 7-10, 1990.

U.S. patent application Ser. No. 07/401086 filed Aug. 1989 to Mueller et al.

U.S. patent application Ser. No. 07/486312 filed Jan. 1990 to Mueller et al.

U.S. patent application Ser. No. 07/560380 filed Jul. 1990 to Mueller et al.

*Primary Examiner*—William P. Neuder

*Attorney, Agent, or Firm*—Gregory F. Wirzbicki; William O. Jacobson

[57] ABSTRACT

A ported float shoe (5) and a landing collar (16) are attached at a first end of a portion of a casing string (4) and a sliding air trapping insert (20) is attached at the other end. The air trapping insert (20) includes a fluid flow passageway (24) blocked by a plug (22) attached by shear pins to the insert (20) or the air trapping insert is an inflatable insert (55) having a conduit (60) providing a fluid passageway to the first end. The air trapping insert and float shoe form an air cavity (12*a* or 12*b*) within the string portion (4). The air cavity provides buoyant forces during running, cementing or other casing operations within a borehole (2), reducing running drag and the related chance of a differentially stuck casing (4). It also allows reciprocation and rotation during cementing and avoids separate removal steps.

24 Claims, 5 Drawing Sheets

WELL CASING FLOTATION DEVICE AND METHOD

Related Applications and Publications

This application is a continuation of application Ser. No. 07/569,691, filed Aug. 22, 1990 which is a continuation-in-part (CIP) of co-pending U.S. Applications: (1) Ser. No. 07/401,086, filed on Aug. 31, 1989; (2) Ser. No. 07/486,312 filed on Feb. 28, 1990; and (3) Ser. No. 07/560,389, filed Jul. 31, 1990, which is a CIP of applications (1) and (2). The teachings of these three prior filed applications are incorporated in their entirety herein by reference.

TECHNICAL FIELD

This invention relates to well drilling and well completion devices and processes. More specifically, the invention relates to an apparatus and method of setting liner or casing strings in an extended reach well, during oil, gas or other well completions.

BACKGROUND ART

Many well completions involve setting a liner or casing string in a portion of the well bore. In some extended reach wells, such as wells drilled from platforms or "islands," a string must be set in a slant drilled (i.e., inclined angle) portion of a deviated hole. The inclined portion is located below an initial (top) portion of a lesser inclined angle. The angle (from vertical) of these inclined holes frequently approaches 90 degrees (i.e., the horizontal) and sometimes exceeds 90 degrees. The result is a well bottom laterally offset from the top by a significant distance. Current state-of-the-art allows extensive drilling of well bores at almost any angle, but current well completion methods have experienced problems, especially related to the setting of casing or liner strings in long, highly deviated well bores.

The liner or casing string is set in a pre-drilled hole. The drill string and bit used to cut the hole is rotated, thereby reducing drag forces which retard the pipe string from sliding into the hole. The diameter and weight of the casing/liner string being set is larger and heavier than the drill string. Because of this, the torsional forces needed to rotate the casing or liner can be greater than the torsional strength of the pipe itself, or greater than the available rotary torque. Casing or liner strings are therefore normally run (i.e., slid) into the hole without drag reducing rotation.

Running in deviated holes can result in significantly increased (high) drag forces. A deviated hole portion is defined as one having an axis in a direction at a significant incline angle to the vertical or gravity direction. A casing or liner pipe string may become differentially stuck before reaching the desired setting depth during running into a deviated or high drag hole, especially if the incline angle exceeds a critical angle where the weight of the casing or liner in the wellbore produces more drag force than the component of weight tending to slide the casing or liner down the hole. If sufficient additional force (up or down) cannot be applied, the result will be stuck pipe string and possible effective loss of the well. Even if a stuck string is avoided, the forces needed to overcome high drag may cause serious damage to the pipe. These problems are especially severe for wells with long, nearly horizontal (i.e., an incline angle of nearly 90 degrees) intervals.

Long, nearly horizontal well intervals may be needed for fluid production from tight and/or thin bed reservoirs or from fields having limited surface access. For example, an offshore drilling site may be unlicensable or excessively costly. The ability to drill from an on-shore site to an offshore resource horizontally displaced from the drilling site by several kilometers may mean the difference between an unavailable and a producing resource.

Even for fields where reservoir access (or permeability) is not a problem, long nearly horizontal well portions may be economically desirable because of higher production rates. Higher production rates may be possible in horizontal well portions from zones where production of unwanted fluids (such as water/gas in oil fields) from adjacent beds, normally occurs in vertical wells, i.e., coning.

Common casing or liner running (i.e., installation) methods to overcome increased drag in a deviated well portion either (1) add downward force or (2) reduce the coefficient of friction, e.g., by lubrication. A modification of the added force approach provides bumpers to deliver downward shocks and blows in addition to added downward static forces.

However, only a limited downward force can be exerted on the pipe string. Excessive downward force can convert a pipe string (normally supported from the top of the well) into a highly compressed member. Compression tends to buckle the string, adding still further drag forces (if laterally supported by the well bore) or causing structural failure (if laterally unsupported). In addition, large amounts of added downward force may be impractical.

Similar limits affect common lubricating or coefficient of friction reducing methods since the coefficient of friction cannot be reduced to zero. These lubricating methods do allow longer pipe strings to be run into a deviated hole. However, as longer lubricated pipe strings are run into the deviated well, unacceptable drag forces will still be generated. The geometry and drilled surface conditions of some holes may also create increased resistance (high drag) conditions in shorter inclined holes, even if lubricating methods are used.

A flotation method of placing a pipe string into a deviated, liquid filled hole is also known. This method is illustrated in U.S. Pat. No. 4,384,616. After providing a means to plug the ends of a pipe string portion, the plugable portion is filled with a low density, miscible fluid to provide a buoyant force. The low density fluid must be miscible with the well bore fluids and the formation. Miscibility is required to avoid a burp or "kick" to or from the formation outside the pipe string when plugged portion fluid is discharged to the formation/well bore. Circulation of drilling mud is also not possible during running or feeding the plugged string into the wellbore. After feeding the plugged string into the well bore, the plugs are drilled out and the low density miscible fluid is forced into the well bore/pipe annulus. Further casing operations, if any, (i.e., cementing) are accomplished without the assistance of a low density miscible fluid providing a buoyant force.

The known string flotation method requires added risk and well completion steps, especially if cementing is required. The low density fluids compatible with the formation and bore fluid must be circulated out ahead of a cement slurry. This requires drilling out the plug(s) prior to cementing of the casing or liner string. Subsequent to the cementing, a second drilling out (of hardened ) is frequently also required. The multiple drilling steps drilling result in costly well completions and increase the risk of damage to the pipe string and formation.

None of the current approaches known to the inventors allow the flotation of a string into a high drag slanted well without a multi-step completion process. The cost of the miscible fluid and multi step completion process has apparently resulted in little or no commercially practical application of the current flotation method.

A simplified flotation device and method are needed to allow the placement and completion of long pipe strings in extended reach well bores. The method and device should also be safe, reliable, and cost effective.

DISCLOSURE OF INVENTION

The invention provides a flotation plug device and process for running a casing or liner into a high drag inclined hole without the need to remove the plug device prior to cementing. In a first embodiment, a float shoe/float collar and a shear-pinned plug insert trap air (or other low density fluids, not necessarily miscible with the formation or well bore fluids) within a portion of the casing string being run in a deviated hole. After running the string to the desired setting depth in a liquid filled hole, a sealed port in the insert is opened to allow the air to be vented to the surface. A cementing bottom wiper plug, induced by applied pressure, forces the plug and insert to slide piston-like within the string to land and latch into a landing collar during normal cementing procedures. The latched plug/insert/landing collar forms a single drillable assemblage. The assemblage is removed during normal post-cementing drilling out, avoiding multiple drilling steps.

The process of using this first embodiment attaches a float shoe and/or float collar (having a flapper or check valve) and a landing collar at one end of an air filled flotation portion of the casing. The float shoe or collar prevents fluid inflow as the casing is lowered into the initial low angle portions of the fluid filled well bore. An insert attached to an upper portion of the casing forms the other end of the "floating" portion. The insert includes a releasable plug (attached by a first set of shear pins) to block a passageway in the body of the insert and contain the air. When a sufficient "floating" length of string is run, the plug insert is attached within and pinned to the string with a second set of shear pins. This seals the air to form a flotation cavity, creating an increased buoyant force on the pipe string when the string is submerged in the fluid filled well bore.

The buoyant forces reduce effective weight, assisting the running of the string to the setting depth by reducing drag forces generated by the effective weight. After setting the string, increased internal string pressure shears the first set of shear pins, opening the passageway. This allows air to vent up the string while mud flows down. After circulation of the mud, a cement slurry is then pumped down-hole separated from the mud by a bottom wiper plug. The bottom wiper plug mates with the open ported insert and shears the second set of shear pins. Shearing releases the mated wiper plug and insert combination to move down-hole. The combination then latches to the landing collar, forming a single drillable assemblage. A top wiper (segregating cement slurry from fluid above the cement slurry) may also be used. A differential pressure across the top wiper forces the cement slurry out and up the bore/string annulus. The assemblage (and top wiper, if used) is drilled out during normal post-cementing procedures.

The ported and slidable air trapping insert allows simplified running of long strings in inclined holes by controlled reduction of effective string weight, not by adding weight or reducing the coefficient of friction. Flotation is achieved without the need to (1) use a miscible low density fluid or (2) separately remove plugs prior to cementing the string.

Another embodiment also forms a flotation cavity in a portion of a tubular string between two ends (e.g., between a shoe and an insert/plug) to be set into a borehole, but adds a conduit between the flotation cavity ends. This embodiment is preferred when sufficient buoyant forces can be obtained when the added space and weight of the conduit within the flotation cavity is considered. The conduit and tubular string now form an annular shaped flotation cavity where the lower density fluid is contained outside the conduit to provide the increased buoyant forces. The conduit (surrounded by the flotation cavity) allows drilling mud and other fluids to circulate during running or other following operations, specifically including cementing.

These methods and devices have the added benefits of possibly allowing a lower lifting capacity rig to be used (since the maximum effective hanging weight is reduced by buoyant forces) and increasing possible tubular string (casing or liner) setting depths, because of reduced drag forces.

Figure 2:
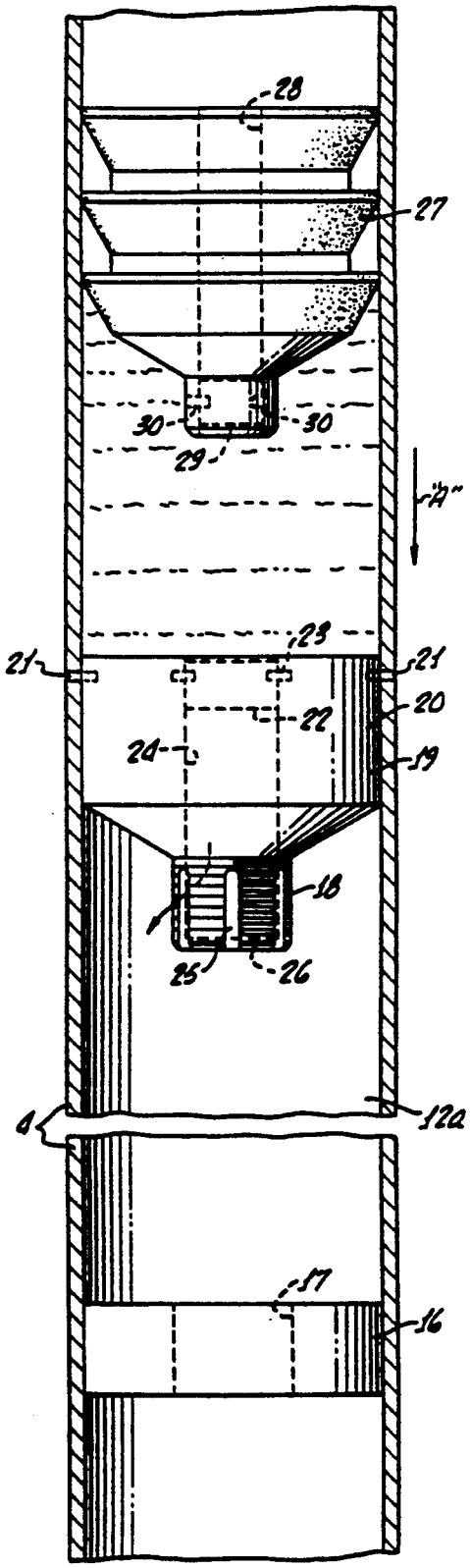
FIG. 2 shows a schematic side view of an alternative embodiment of the flotation device during installation.
Figure 4:
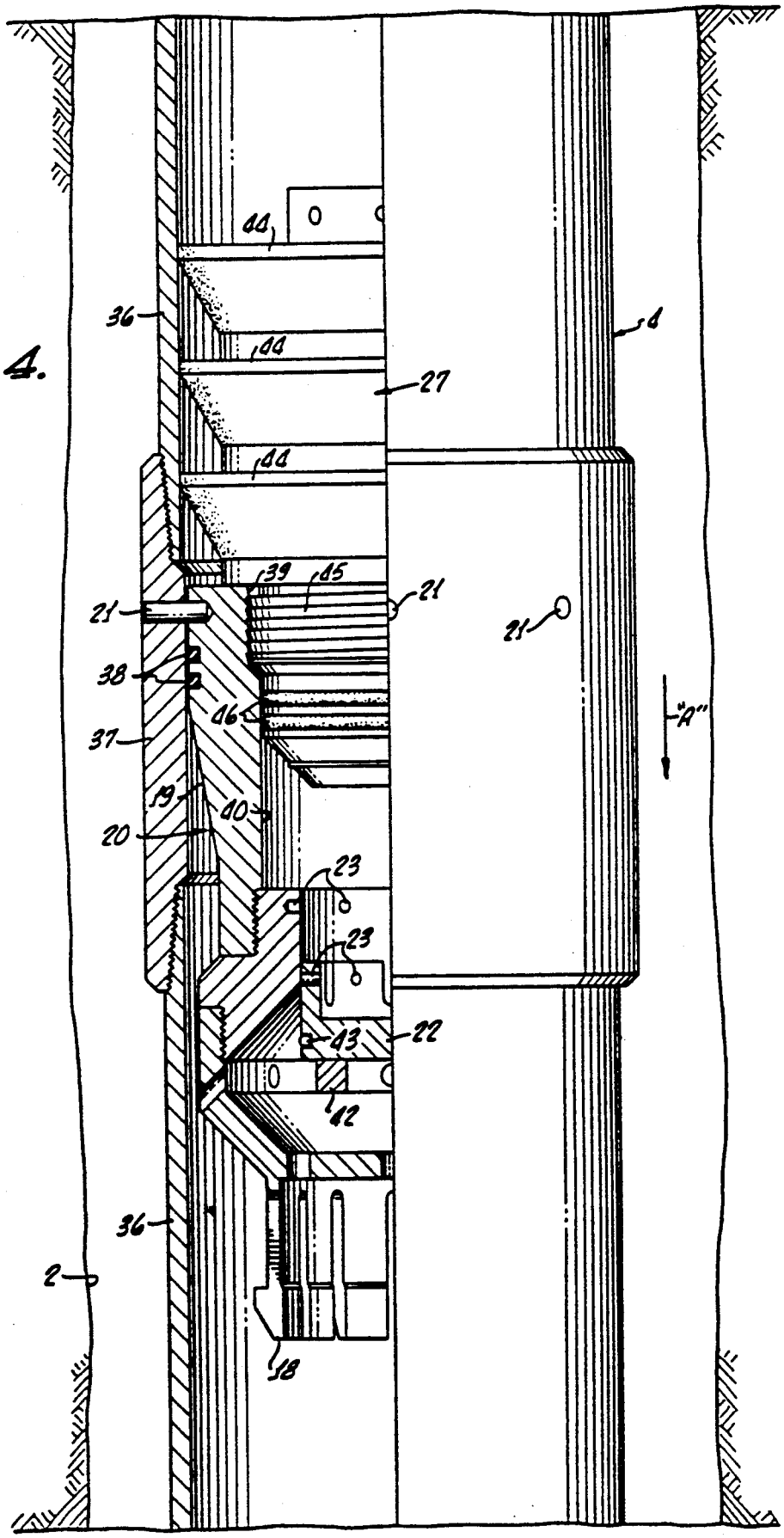
Figure 5:
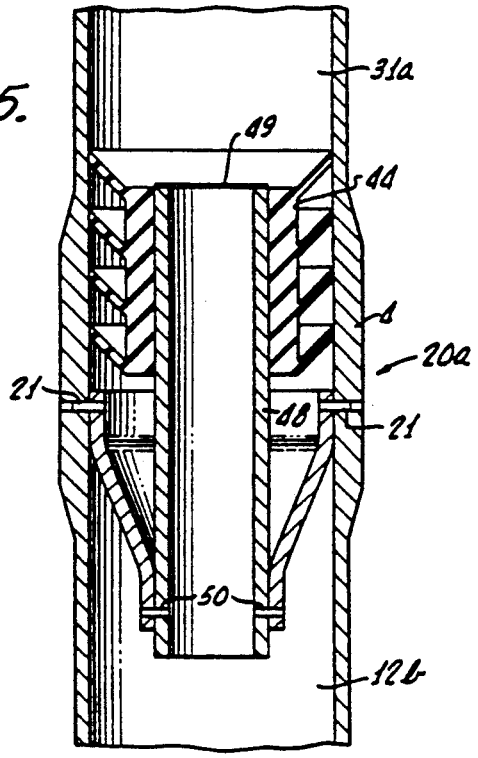
Figure 6:
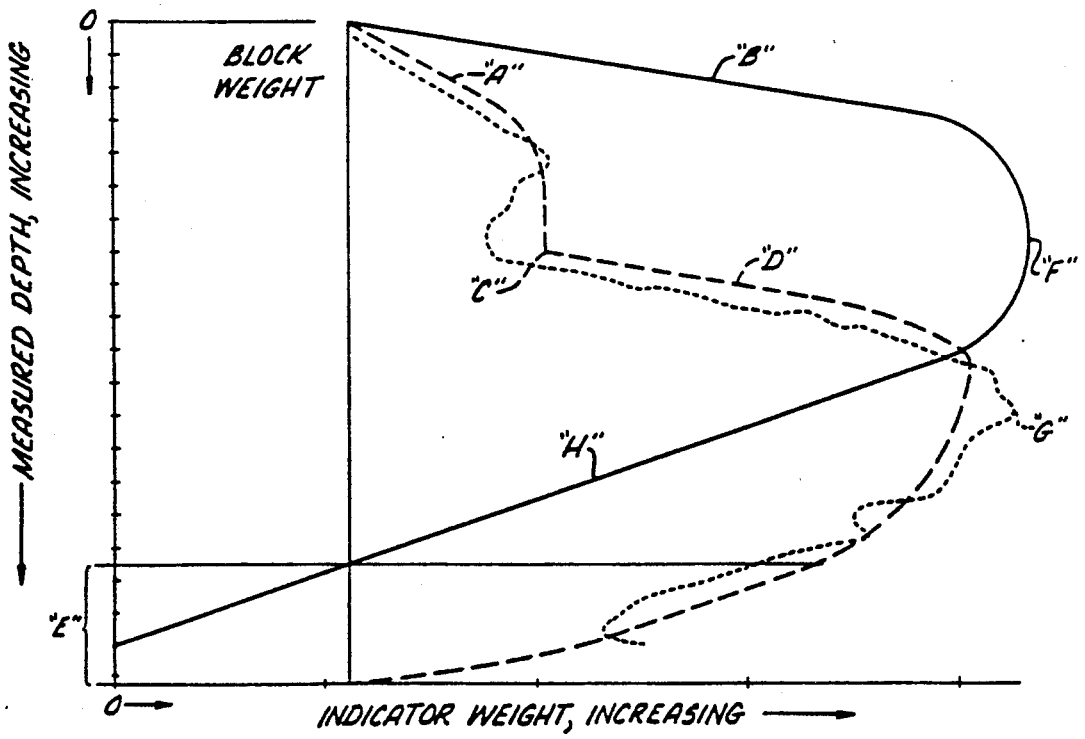
Figure 7:
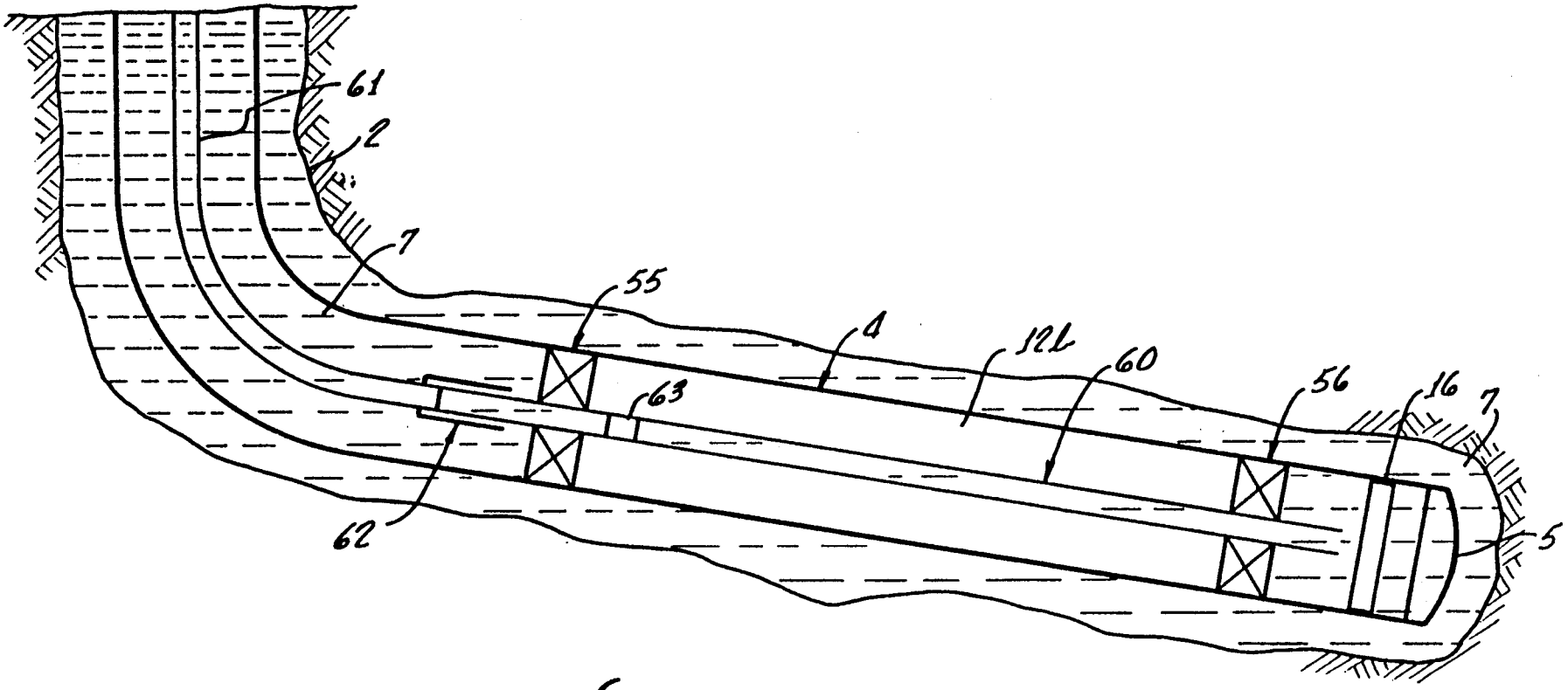

FIGS. *3a* through *3f* show simplified representations of the alternative device during well completion activities;

FIG. 4 shows a side and partial cross sectional view of an air trapping device portion of the engaged assemblage;

FIG. 5 shows a side cross-sectional view of another alternative embodiment;

FIG. 6 is a graphical representation of the results of a test of the flotation device; and FIG. 7 shows a schematic side view, similar to FIG. 2, of an alternative air annulus embodiment during installation.

In these Figures, it is to be understood that like symbols and reference numerals refer to like elements, methods or features.

BEST MODE FOR CARRYING OUT THE INVENTION

Figure 1:
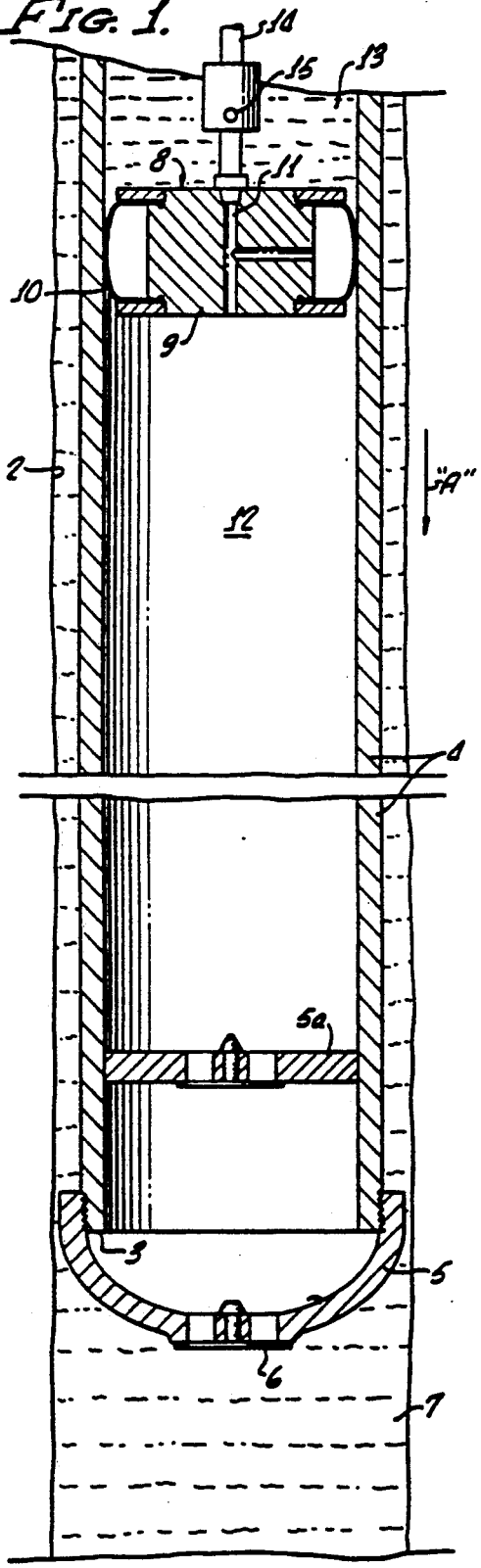
FIG. 1 shows a schematic cross sectional view of one flotation device used to provide buoyant liner or casing forces during running operations.

FIG. 1 shows a schematic cross-sectional view of one embodiment for running a casing string (or liner or other duct) into a fluid filled bore hole (or cavity) 2. A portion of the casing or liner string 4 is placed in the top vertical or low angle section of drilled bore hole 2 (lower slanted or high angle portion not shown for clarity). The bottom end 3 of liner or casing string 4 has a float shoe 5 attached. The float shoe 5 includes an outwardly or downwardly opening flapper or check valve 6. The valve 6 prevents inflow of a first or bore fluid 7 during the running or lowering of the string (see downward direction "A" shown on FIG. 1) into the well bore 2. The flapper (or ball) of valve 6 may be spring or otherwise biased closed to prevent inflow, but allow pressurized fluid outflow (in the downward direction "A"). Outflow occurs if the pressure force within the string 4 can overcome flap seating forces and bore fluid 7 pressure forces.

A releasable and inflatable bridge plug (or packer) 8 is located at the other (second or top) end of a portion of the string to contain air, i.e., to be "floated" in the liquid filled borehole 2. The bridge plug 8 comprises a cylindrically shaped solid form 9 and an elastomeric bladder (or diaphragm) 10. Pressurizing the bladder 10 through port 11 traps air or other flotation fluid within a flotation cavity 12 below the bridge plug 8 and prevents the entry of third (or non-flotation) fluid 13 from above the bridge plug 8 into cavity 12.

FIG. 1 shows the bladder 10 in a fully inflated position. Inflation is achieved by applying air or other second fluid pressure through open venting ports 15 in stem 14 (source of inflation air is not shown for clarity). Inflation also pressurizes the flotation cavity 12 to prevent collapse of the string under down hole conditions. After inflation, pulling or twisting of stem 14 closes the air venting ports 15 and the source of inflation can be removed.

The bore fluid 7 is normally a single density drilling mud, but may also be a mixture or several layers of different density fluids. The various densities within the well bore allow a single flotation cavity 12 to have different buoyant forces at different portions of the well bore proximate to different density bore fluids. This can be highly desirable in extremely high drag well bores or variable incline angle bore portions.

The distance between the float shoe 5 at one end of the flotation cavity 12 to the bridge plug 8 at the other end is variable to allow control of buoyant forces generated. Repositioning the bridge plug 8 changes the buoyant forces on the "floating" pipe string portion enclosing cavity 12. The float shoe 5 is installed at the surface before entry of the casing string end into the bore hole 2. The length of the flotation cavity or portion of the string is selected to control the force tending to run the casing into the hole. The bridge plug 8 seals and is attached to the duct by pressurizing the bladder after installing the length of "floating" pipe string portion into the bore hole 2.

Alternatively, repositioning the bridge plug when in the hole may also be possible to further adapt and change buoyant forces, if required. This can be useful when bending a tubular member through an arced borehole portion (e.g., running a casing through a build section of an extended reach well). Buoyant forces in a non-vertical borehole portion can provide bending forces (e.g., buoyant forces exceed the weight of a buoyed portion of pipe string ahead of a non-buoyed portion in an inclined borehole curving towards a horizontal orientation), and repositioning the bridge plug can adjust these bending forces to adapt to the specific incline/curvature/bending needed.

The diameter and cross sectional thickness (and associated weight) of the pipe string enclosing cavity 12 can be set equal to the weight of the displaced bore fluid 7. This creates a neutral buoyancy so that this "floating" section exerts no upward or downward forces on the walls of the bore hole 2, regardless of orientation or slant. Even if neutral buoyancy is not desired, the controlled effective (buoyed) weight of the selected casing/liner pipe string which must be supported (hung) and any resulting drag during installation operations can be significantly reduced. This reduced maximum effective weight may allow a smaller capacity derrick or rig to be used, or added safety when using a larger one.

The remainder of the string above the bridge plug 8 is fluid filled with a third or heavier fluid 13, such as drilling mud. The larger effective weight of the remaining non-flotation portion forces the flotation cavity pipe string portion to the other (i.e., higher incline angle) portions of the well bore 2 (see FIG. 3). These other well portions may be nearly horizontal.

The non-flotation portion may extend to the surface, i.e, fill the remainder of the string with the heavier fluid 13. In some applications or embodiments, string installation may require a second or multiple floating portions within the string, separated by other bridge plugs 8, especially for deviated hole portions having different angles.

After the casing is run to setting depth, a retrieving device is run on the end of drill pipe and latched on the retrieving stem (or fishing neck) 14. The ports 15 are opened by the action of the drill pipe latching or twisting onto the retrieving dog on stem 14. The ports 15 may also be remotely actuated in an alternative embodiment. These opened venting ports 15 allow the higher density fluid 13 to exchange places with the lower density fluid (air) in cavity 12. The bridge plug 8 is also then deflated by twisting and/or pulling on the retrieving stem 14.

An alternative embodiment can separately actuate cavity pressurization/venting and bladder inflation/deflation. Cavity pressurization may not be required if the string can withstand the differential pressure. Fluids (water in this embodiment) used to inflate bladder and pressurize cavity which can also be segregated in this alternative embodiment.

The fluid flow around and/or through bridge plug 8 allows air within the cavity 12 to rise and be vented from within the string 4 at the surface. Fluid flow through plug 8 also allows cavity 12 to be filled with the higher density (or non-flotation) fluid 13. Heavier fluid 13 is typically a drilling mud but may be another fluid having a density greater than the second fluid in cavity 12. After venting, the drill pipe and bridge plug 8 may be removed from the casing 4, and normal cementing operations may commence.

A restricted float collar **5*a* serves as a redundant fluid inflow prevention means. The restricted float collar 5*a* is similar in construction to the float shoe 5, including a flapper or check valve 6, and again prevents bore fluid 7 from entering the air-filled cavity. The restricted float collar 5*a* is attached to the pipe interior near the float shoe 5. If the bridge plug is not removed, the restricted float collar 5*a* attachment and the shape of the interfacing (after the bridge plug slides down) top collar surface and the bottom surface of the bridge plug 8** are designed to grab, preventing interface sliding and rotation during post cementing drilling out operations.

Alternative embodiments could also include a restricted float collar **5*a* in place of (in contrast to redundant with) the float shoe 5 or the addition of a latch-in landing collar 16 (see FIG. 2) near the float collar 5*a*. The float collar 5*a* can also form a flotation cavity away from the end of the string since it is attached to an interior portion of the string 4, rather than at the end of the string 4**.

FIG. 2 shows a schematic side view of another embodiment of an apparatus for floating a portion of a casing or liner string during running. A latch-in landing collar 16 is attached to the casing or liner string 4 near the float collar/float shoe end (see FIG. 1) of the cavity 12*a*. The latch-in collar 16 includes a threaded or latching aperture 17 (shown dotted in FIG. 2 for clarity) which engages a threaded or latching protrusion 18 of an air release plug holder 19 of an air trapping device (or member) 20.

The piston-like air trapping device 20 also includes an air release plug 22 (shown dotted for clarity). A first set of (or passage) shear pins 23 attaches the release plug 22 to an internal port (or passageway) 24 (shown dotted for clarity) within the plug holder 19. A second set of (or plug holder) shear pins 21 attaches the plug holder 19 to the liner/casing 4. The size and shape of the plug 22 and internal port 24 allow the sheared away plug 22 to slide down (direction "A" is towards the well bottom, not necessarily vertically down) toward the protrusion 18. After moving/sliding the plug 22 down, the internal port 24 is in fluid communication with both the cavity 12*a* below (through slotted ports 25) and the non-flotation fluid 13 above the translated plug 22. The lateral slotted ports 25 allow fluid passage to and from the lower portion of the internal port 24 and the cavity 12*a* (fluid flow shown as a solid and dotted arched arrow). The height of plug 22 is selected to be less than height of the slotted ports 25, allowing fluid flow in this lower portion. A basket 26 near the bottom of the air trapping device 20 acts as a retainer of the plug 22 within the internal port 24 when the passage shear pins 23 break and plug 22 moves downward under fluid pressure from above.

After venting the trapped air from the cavity 12*a* and circulating drilling mud to the formation/string annulus (see FIG. 3), a cement slurry is introduced into the string above the air trapping device 20. A bottom wiper plug 27 separates the cement slurry above wiper plug 27 from the drilling mud 13 above the air trapping device 20. A third set of (or wiper) shear pins 30 attaches an inner wiper plug 29 to a wiper plug port 28 (shown dotted) of the wiper plug 27. The inner plug 29 prevents fluid communication above and below the wiper plug 27 until the inner plug 29 moves (i.e., is sheared away) from the plug port 28.

An initial (before wiper shear pins are sheared) fluid pressure from a source at the surface creates a differential pressure across the wiper plug 27. Pressure differential will tend to move the wiper plug 27 (in direction "A") towards the air trapping device 20. When the wiper plug 27 element reaches the air trapping device 20 element, the elements are shaped to join together. They are also shaped to be capable of sliding as a unit when joined. When the pressure differential across the wiper plug 27 is increased, a force that will rupture the plug holder shear pins 21 is then produced. The joined wiper plug 27 and air trapping device 20 will then slide toward the landing collar 16 as a unit. Upon reaching the landing collar 16, a further increase in pressure differential will rupture the wiper shear pins 30. Cement slurry above the wiper plug 27 can then circulate through landing collar 16, float collar if installed (not shown), and float shoe 5 (see FIG. 1) into the annular space between well bore 2 and casing 4.

Each set of shear pins is selected to rupture at increasingly incremental pressures above normal operating hydrostatic pressure within the string. This alternative embodiment uses a (differential) pressure increment of 34 atmospheres (500 psi) to prevent accidental actuation (shearing). Thus the first set of shear pins 23 rupture at approximately 34 atmospheres (500 psi) over hydrostatic (allowing air to vent and mud to circulate), the second set of shear pins 21 (allowing the piston-like trapping device to translate) are set at approximately 68 atmospheres (1000 psi) over hydrostatic, and the third set of shear pins 30 (allowing cement slurry flow) are set at approximately 102 atmospheres (1500 psi) over hydrostatic.

FIGS. 3*a* through 3*f* show simplified representations of the alternative apparatus shown in FIG. 2 during well completion activities in the deviated well bore 2. When the inclined angle "i" (angle between the center line of the slanted well portion and the vertical shown in FIG. 3*a*) approaches larger (nearly horizontal) values, a positive means to prevent fluid inflow to the bottom of the air filled cavity is needed, i.e., float shoe 5. Lower incline angle holes may avoid using a float shoe, depending upon density differences and the lack of fluid miscibility to limit inflow to the flotation portion. Large incline angles "i" can also indicate the need for a flotation method of running the casing into the hole.

Operations in large inclined angle "i" well bores are at most risk of a stuck casing string. At an incline angle at or exceeding a critical angle and friction factor, the drag generated by the pipe section is equal or greater than the weight component tending to slide the pipe section into the hole. For friction factors ranging from 0.2 to 0.5, this critical angle ranges from 78.7 degrees to 63.4 degrees, respectively. Flotation methods are therefore indicated when the inclined angle "i" is greater than these critical values for a substantial distance.

Figure 3A:
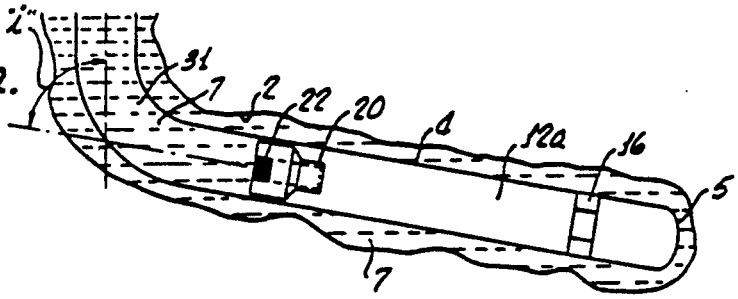

FIG. 3*a* shows the initial apparatus positions after installing the string 4 in the deviated well bore 2. The cavity 12*a* includes landing collar 16 between the float shoe 5 and air trapping device 20. The air release plug 22 (shown darkened for clarity) is shear pin attached to air trapping device 20 (see FIG. 2). Cavity 12*a* contains trapped air or other low density fluid, creating buoyancy during the (just completed) insertion of the string portion into the bore hole 2 containing drilling mud 7. In this embodiment, drilling mud 7 is also the non-flotation fluid (see item 13 in FIG. 1) present above the air trapping device 20 in a non-flotation (or high density fluid filled) cavity portion 31. The apparatus geometry and mud density can be adjusted to control buoyancy and the effective weight of the casing 4 proximate to the cavity 12*a*.

Figure 3B:
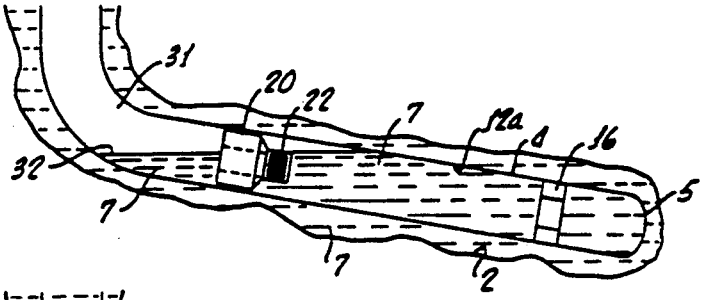

FIG. 3*b* shows the apparatus of FIG. 3*a* after rupturing the first set of shear pins 23 (see FIG. 2) and movement of the air release plug 22. An increased pressure above the air trapping device 20 sheared the first set of pins. The positions of the elements are unchanged except for the release plug 22. The sheared-away release plug 22 may be biased and/or pressure actuated to slide towards the cavity 12*a* to open ports 25 (see FIG. 2). Opening ports 25 allow fluid communication between the air cavity 12*a* and non-flotation (i.e., filled with a higher density fluid) cavity portion 31. Because of the fluid density differences, shape of the passage 24, downward sloping orientation of the bore hole 2, and fluid communication through the internal port 24 to the surface, the air from cavity 12*a* migrates upward in the casing of liner 4 so that it may be then vented at the surface. In wells that have an incline angle of greater than 90 degrees, it may be necessary to positively vent air from cavity 12*a*. As shown in FIG. 3*b*, the drilling mud 7 and displaced air form a mud-air interface 32 in the previously weighted cavity 31. The previously buoyant cavity 12*a* is now full of drilling mud 7.

Another alternative embodiment can provide a plurality of internal ports 24 and release plugs 22. This embodiment would assure migration/displacement of fluids in various orientations, e.g., at least one internal port primarily for venting air towards the surface, another for flowing drilling mud into cavity 12*a*.

Figure 3C:
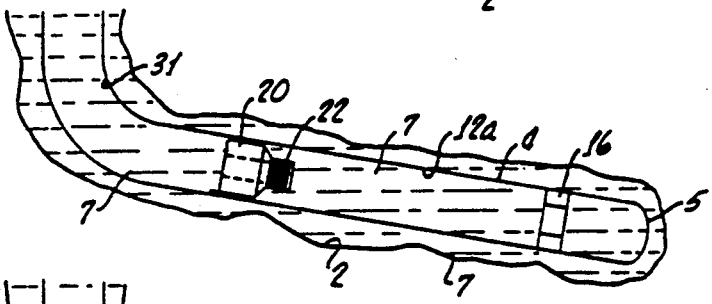

FIG. 3*c* shows the devices of FIG. 3*b* after the air (above the mud-air interface shown on FIG. 3*b*) is vented at the surface (not shown for clarity) and replaced with drilling mud 7. Position of the devices is unchanged, except that drilling mud 7 fills all of the string interior and the annulus between the liner/casing string 4 and well bore 2. Circulation of drilling muds is now possible, if required for hole cleaning or other reasons, without "burps" or "kicks."

Figure 3D:
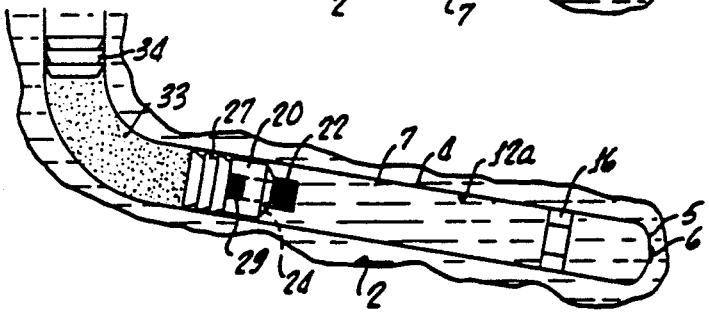

FIG. 3*d* shows the devices after installing and pumping a bottom wiper 27 (i.e., a plug wiping the interior surface of the string as it moves) to mate with the air trapping device 20. Above the bottom wiper 27 is a cement slurry 33. Drilling mud 7 within the casing 4 above air trapping device 20 has been displaced through passage 24 (See FIG. 2) in the air trapping device 20, landing collar 16, and flapper valve 6 of the float shoe 5 (see FIG. 1). To limit and segregate the top of a fixed amount of cement slurry 33, a top wiper 34 contains the cement slurry 33 between the two sliding and sealing wipers.

When forced by a differential pressure, the portion of the bottom wiper 27 proximate to inner plug 29 (shown shaded for clarity) mates within the internal port 24 of the air trapping device 20 (see FIG. 2). This seating or mating of the bottom wiper 27 to the air trapping device 20 and a further increment of differential (above hydrostatic) pressure across the mated devices applies a shearing force to the second set of shear pins 21 (see FIG. 2).

Figure 3E:
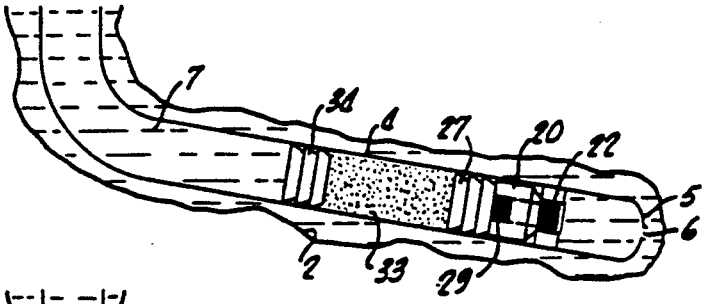

FIG. 3*e* shows the devices after breaking the second set of shear pins 21 (see FIG. 2) attaching the air trapping device 20 to the casing 4. The released air trapping device 20 and bottom wiper 27 are shown having been translated to land and latch or threadably engage the landing collar 16, which prevents rotation of the landed assemblage. Wiper plug 29 contains the cement 33 between the landed assemblage at the landing collar 16 and the top wiper 34. The drilling mud 7 previously contained in cavity 12*a* (see FIG. 3*d*) has been displaced and flowed though the landing collar 16 and flapper valve 6 of float shoe 5 into the annular space between well bore 2 and casing/liner 4. Displaced drilling mud continues to flow through the float shoe 5 until the top wiper 34 joins the assemblage. Applying another pressure increment tends to shear the third shear pin set 30 (see FIG. 2) holding the wiper plug 29.

Figure 3F:
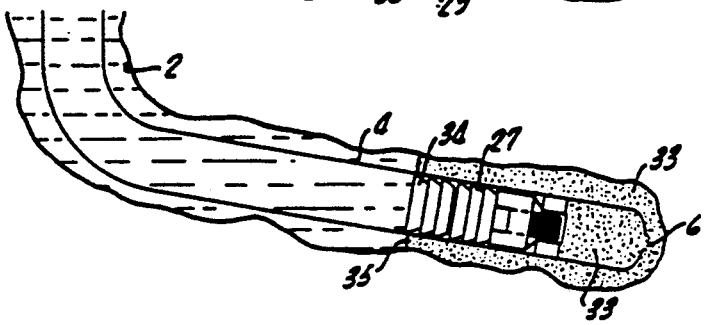

FIG. 3*f* shows the top wiper plug 34 joined to the assemblage and cement slurry 33 nearly fully displaced out of the string 4 to the annulus between the casing/-liner 4 and well bore 2. Shearing and displacing the wiper plug allows the cement to flow through the bottom wiper plug 27 and the slotted ports 25 (see FIG. 2) to the annulus between the casing 4 and well bore 2 through flapper valve 6. The pressurized cement flow also causes the top wiper 34 to slide and contact the bottom wiper plug 27. The cement-mud interface 35 (previously separated by bottom wiper 27) is now in the annulus between the well bore 2 and casing 4. A portion of the cement slurry 33 remains between the assemblage and float shoe 5. This residual cement is drilled out (after setting) in normal post cementing operations (not shown).

FIG. 4 shows a side and partial cross sectional view of the engaged bottom wiper 27 and pinned air trapping device 20 assemblage within a joint in the casing string 4. The casing string 4 (shown quarter sectioned) in hole 2 is composed of many sections of pipe segments 36 joined by a drift (or piping) collar 37 at each end. The piping collar 37 is internally threaded to join the external threaded ends of pipe segments 36. The illustrated pipe string joint is typical of the string of joined pipe segments. An alternative pipe string can used without interconnecting pipe segments, avoiding the need for a piping or drift collar 37.

The piping shown is attached to the air release plug holder 19 portion of the air trapping device 20 (shown in cross section) by the second set of shear pins 21. The air trapping device 20 also includes a pair of holder O-ring seals 38 forming a fluid tight sliding connection to the interior of the string 4. The internal port 24 (see FIG. 2) includes an initial threaded portion 39, a cylindrical wiper plug mating portion 40 and a release plug cylindrical portion 41.

The plug 22 was retained by the first set of shear pins 23 (shown sheared in FIG. 4). A pressure differential was applied sufficient to break the plug shear pins 23 and translate the plug 22 to rest against the perforated basket 42 (similar to basket 26 shown in FIG. 2). The plug 22 also includes a plug 0-ring seal 43 which, when plug 22 is pinned in the initial position, formed a fluid tight sliding seal to the plug cylindrical portion 41 of the internal port 24 (see FIG. 2). The perforated basket 42 catches and prevents further translation or loss of the plug 22. The perforations of basket 42 and ports allow fluids to pass around the displaced plug 22.

The air trapping device 20 also includes a latch protrusion 18 which attaches to the landing collar 16 (see FIG. 3) after the second set of shear pins 21 are broken and the assemblage has been displaced to landing collar 16. The protrusion 18 and latch or threaded portion 39 prevent rotation of the assemblage (wiper plugs, air trapping device and landing collar) when the assemblage is being drilled out.

The bottom wiper plug 27 (shown in side view for clarity within sectioned casing string 4) includes a series of elastomeric cup shaped wipers 44, an external threaded or latch portion 45 (threadably mating with the internal threaded or latch portion 39 of the air trapping device 20), a pair of elastomeric wiper 0-rings 46 (shown darkened for clarity and bearing against the interfacing passageway portion 40), and (hidden from view) an inner plug 29 held in place within wiper port 28 by a third set of shear pins 30 (see FIG. 2).

An alternative embodiment can extend the bottom wiper dimensions to positively displace the plug 22 when bottom wiper contacts and mates with air trapping device 20 (see FIG. 2). Other types and locations of elastomeric seals, and other mating shapes and dimensions may also be provided for other alternative embodiments. Solid materials of construction of the air trapping device 20 are primarily 6061 aluminum, but various other materials of construction can be used, as long as they are drillable or otherwise removable.

The bottom wiper 27 acts as a sliding and wiping seal or separator along the interior of the casing. The bottom wiper 27 separates cement on the upstream side from fluid on the downstream side during certain fluid movements, i.e., slurry cement pumping down-well (direction "A"). The orientation (right hand engaging) of the external and internal threads shown in FIG. 4 are selected to tighten or engage the air trapping device during drilling and prevent unlimited rotation.

Several advantages of the present invention to the prior flotation methods can be discerned. The first advantage is that the present invention avoids the need to use miscible flotation fluids. Air (or any other low density fluid, whether miscible or not) is safely contained and vented to the surface from *within* the string. A second advantage of the present invention is it avoids the need to remove wiper/plug/insert devices in order to circulate mud or cement slurry. Shear pinned plugged ports open to allow flow for normal circulating, cementing, and drilling out or other operations.

A third advantage is the translating/latching ability. The various components translate and latch together to form a single drillable unit latched to the landing collar. The unit or assemblage does not rotate or spin with the rotating drill, avoiding drilling difficulties. The drillable unit's location at a single known depth eliminates multiple drilling or retrieval operations at various depths.

These advantages are compounded if using multiple floating segments. The protrusion 18 (see FIG. 4) can be designed to include a nesting ability with other air trapping devices 20 which would form the ends of multiple floating segments. The protrusion 18 would latch into the internal portion 39 of a second (nested) downstream located air trapping device. The nested air trapping devices again secure multiple segments within an assemblage at a single landing collar for post cementing drilling out procedures.

A further advantage of this embodiment is the use of existing components, simple fabrication and design. The top and bottom wiper plugs can be produced by modifying a commercially available liner wiper plug. The use of 6061 aluminum results in light weight and easily machinable components of the device.

FIG. 5 shows a side cross-sectional view of another alternative embodiment of an air trapping device or an air plug 20*a*. A second set of shear pins 21 attaches the air plug 20*a* to the casing pipe string 4. The air plug 20*a* is similar in construction to a conventional bottom cementing plug. The air plug 20*a* includes an aluminum insert 48 covered by rubber wipers 44. A rupture diaphragm 49 separates the flotation cavity 12*b*, retaining air (or other low density fluid such as nitrogen or light hydrocarbon fluids) from the higher density fluid filled cavity 31*a*. The rupture diaphragm 49 replaces the releasable plug 22 and shear pins 23 of this alternative embodiment (see FIG. 2). The rupture diaphragm 49 has the advantage of simplicity, but may not be capable of withstanding the down hole pressures and forces or be removable without difficulty. Still other alternative embodiments could replace other slidable plugs and inserts with rupture or burst diaphragms.

Once the casing or liner string is run to the total or desired depth, increased pressure is applied to burst the diaphragm 49. Similar to the previous discussion, the ruptured diaphragm allows the trapped air from cavity 12*b* to migrate to the top of the well and be replaced by drilling mud. The air is again vented at the surface (not shown for clarity). Circulation of the drilling muds can now be accomplished in this embodiment, if required. Near normal cementing operations can now be accomplished. The cement slurry flows past the ruptured diaphragm until the top cement wiper 34 (see FIG. 3E) engages the air plug 20*a*. Increasing the cement slurry pressure on the engaged air plug/wiper fractures the second set of shear pins 21. If the wipers 44 are slidably attached to the insert 48, another set of shear pins 50 can be used as a redundant means to allow fluid exchange in addition to the rupture diaphragm 49 (allowing fluid exchange even if rupture diaphragm does not rupture).

Results using one embodiment of the present invention are illustrated by the following example:

EXAMPLE 1

FIG. 6 is a graphical representation of the results of a test of the flotation method in a deviated underground well bore. The devices and methods used were similar to those shown and described in FIG. 1. FIG. shows the actual and expected indicator (or slack-off) weight supported during installation of the casing pipe string 4 (see FIG. 1). The string was installed by sections from a derrick at the surface.

The bore fluid for this example was a drilling mud having a density related value of approximately 1137 kilograms/cubic meter (71 pounds/cubic foot). The casing used was a 9⅝ inch (24.45 cm) nominal diameter pipe string. The resulting buoyed weight of mud filled casing was approximately 54.78 newtons/meter (40.4 pounds/foot), whereas the buoyed weight of the air filled cavity portion was 15.73 newtons/meter (11.6 pounds/foot).

After verifying air filled casing would not collapse under the increased pressure differential (when compared to the differential pressure resulting from a mud filled casing), approximately 1219 meters (4000 feet) of casing (having a float shoe attached at the bottom end and centralizer bands on the bottom for approximately 853 meters or 2800 feet) was initially run into the hole to form the flotation cavity. An inflatable packer was set at the other end of the 1219 meter (4000 foot) section and the remaining casing run into the hole. The dog on an inflatable packer was latched and air venting ports opened (see FIG. 1) for 15 minutes to allow the air within the casing to migrate to the surface for removal. The packer was then deflated (i.e., dog was twisted). Mud circulation was followed by generally normal cementing and post cementing (drilling) operations.

The expected results without flotation (solid curve), the expected results with flotation (dashed curve) and the actual indicator weight results using the flotation method and devices (dotted curve) are shown in the graph of FIG. 6. The initial actual (dotted line) and associated expected (dashed line portion "A") indicator weight increasing with depth shows a significant reduction in supported (indicator) weight, when compared to the non-flotation method (solid line portion "B"), was achieved by the buoyant effect on the floated portion of the string within the fluid filled well bore.

The remaining string portion above the air filled cavity (point "C" on flotation expected curve) was filled with drilling mud. The actual and flotation expected curve shape (dotted and associated dashed line portion "D"), are similar to, but displaced from, the expected non-flotation curve shape (solid line "B"). This displacement allows the string to be placed to a greater depth (depth increment "E") before the supported weight becomes insufficient to move the string into the bore hole. The dotted and dashed curve shape (and ability to install casing or liner) can be altered by changing the number and length of the floated sections as well as by using a flotation fluid other than air or changing the density of the mud in the borehole or the mud above the flotation device.

During the installation in the initial low angle portion of the well bore, the prior art non-flotation method (shown as a solid curve) was expected to produce a larger maximum force (or indicator weight as shown at point "F") to overcome the later developed frictional drag when compared to the flotation method maximum indicator weight (point "G"). However, as the casing end approaches the lower portion (solid line portion "H") beginning at approximately 2286 meters (7500 feet), the mud filled sections generate more drag (shown by the indicator weight declining with depth) than can be overcome by weight (i.e., exceeds critical incline angle). If the particular well included an even higher incline angle section, the decline in indicator weight would be even more severe.

The results of this test example show that flotation of the casing displaced and maintained a controlled margin of supported weight during the entire installation procedure, avoiding a stuck casing. The results also show that a reduced maximum indicator weight was achieved while allowing a deeper installation and avoiding multiple drilling out procedures.

FIG. 7 shows a schematic side view, similar to FIG. 2, of another alternative embodiment (i.e., an air annulus embodiment) of the apparatus when near the location where the casing is to be set (i.e., one end of a casing string 4 is near the bottom of the wellbore 2). The extended reach wellbore 2 contains one or more drilling muds 7 having densities greater than air (or other fluid in cavity 12*b*) and a casing string 4. A portion of the casing string 4 and ported packers/ retainers 55 and 56 forms the exterior surfaces of a modified "flotation" cavity 12*b*, similar to the cavity 12*a* shown in FIG. 2. Above the modified cavity 12*b*, the casing string 4 also contains drilling mud 7, similar to FIG. 2. The pipe string 4 has a float shoe 5 and float collar 16 attached proximate to one end of the pipe string similar to FIG. 2, but the ends of the modified cavity 12*b* within the pipe string 4 are defined by a pair of inflatable packers/-retainers 55 and 56, similar to the bridge plug 8 shown in FIG. 1.

The air annulus embodiment also contains a conduit 60 forming the interior surface of (i.e., is surrounded by) cavity 12*b*. The conduit 60 provides a passageway for fluids from one end of the modified cavity 12*b* to another (i.e., conduit 60 is attached to ports in the upper inflatable packer 55 and lower cement retainer 56). The conduit 60 is attached in this embodiment to a surface connecting conduit 61 (typically a string of smaller diameter drill pipe sections) within the remainder of the casing string 4. The fluid shown within conduits 60 and 61 is drilling mud 7, allowing drilling mud 7 to be circulated during running or other operations, but a cement slurry or other fluid may also be conducted. Mud circulation (i.e., pumping drilling mud at the surface through the casing string 4, surface connecting string 61, and conduit 60 to the borehole 2 through float collar 16 and float shoe 5 to the annular space between the casing string 4 and borehole 2, then screened or filtered to remove particles (e.g. cuttings or other formation solids) prior to returning to the surface pump) allows lubrication and other fluid properties to assist in the running operations, while the casing string is buoyed within the drilling muds in the borehole 2.

After the set location of the casing string 4 is achieved or approached as shown in FIG. 7, the surface connecting conduit 61 can be run within the casing string 4 to connect with the conduit 60 at an overshot connector 62. Alternatively, the surface connecting conduit 61 can be pre-assembled and run into the borehole 2 concurrently with the casing string 4. A removable plug 63 shown in the conduit 60 is optional, provided if needed to prevent drilling mud from flowing in the conduit during portions of the operations when flow is unwanted, such as pressure testing. Removable plug 63 from conduit 60 can be removed by differential pressure.

This air annulus embodiment specifically allows flotation and reciprocation of the casing during cementing operations. A cement slurry can be fed through the surface connecting conduit 61 and conduit 60, out through the float collar 16 and float shoe 5 to the annulus between the casing 4 and borehole 2 while reciprocating the casing to obtain improved slurry distribution in the annulus and (after setting) bond strength. Improved distribution helps prevent channeling and other problems.

The cementing process first runs a first portion of the casing 4 (with conduit 60 and packers/retainers 55 & 56) into the borehole 2. The cement retainer 56 is set and tested (e.g., a test of its integrity against fluid pressure). Plug 63 (i.e. a wire-line plug) is then set in a fitting (e.g., an XN nipple) in conduit 60 and tested. Packer 55 is then inflated and tested. Plug 63 is then pulled and conduit 60 is filled with mud 7. The remaining portions of the casing 4 are run in hole while circulating mud 7. The surface connecting conduit 61 is run in hole, latching and sealing at overshot connector 62 to conduit 60. The casing 4 is reciprocated (i.e., translated in an oscillating manner along the borehole axis) and drilling mud 7 is circulated until clean (free of filterable solids). A cement slurry is then pumped down the surface connecting conduit 61 and conduit 60 while the casing is reciprocated. The casing is then located (i.e., landed) and the cement allowed to set. Inflatable packer 55 can be deflated before or after cement setting, along with the venting of air in cavity 12*b* and pulling out surface connecting conduit 61, conduit 60, inflatable packers/-retainers 55 & 56.

A similar procedure is used to run, rotate and cement a liner (not shown, but similar to casing 4 shown in FIG. 7). Typically, the liner is a tubular string to be contained in a lower portion of the borehole 2 and attached or hung from a larger diameter up-hole casing section. At least a first portion of a liner is run into the borehole 2. The lower cement retainer 56, plug 63 and upper inflatable packer 55 are similarly set and tested in the liner. Plug 63 is removed and the assembly is filled with drilling mud 7 except for cavity 12*b*. The surface connecting conduit 61 is similarly latched and sealed to connector 62, followed by running the liner and surface connecting conduit 61 in hole. The liner is then rotated (in an oscillating or continuous manner) and drilling mud is circulated clean. A cement slurry is pumped down the conduits out to the borehole/liner annulus while the liner continues to be rotated, again improving distribution and bond strength. When ready to allow the cement to set, the liner is released (hung on casing), the packer is deflated, and surface connecting conduit (drill pipe), packer(s) and conduit are pulled out. Alternatively, a modified air trapping device similar to the device 20 shown in FIG. 2 may be used in place of the upper inflatable packer 55. The modified device includes another port for connecting to conduit 60. Still further, conduit 60 may be directly connected to a modified float shoe or float collar similar to the shoe 5 and collar 16 shown in FIG. 2.

Results using an air annulus embodiment of the present invention are illustrated by the following example:

EXAMPLE 2

A 17.8 cm (7 inch) nominal diameter, 129 newtons (29 pound) nominal weight liner string approximately 1676.4 meters (5,500 feet) long is to be run to 4572 meters 15,000 feet) total measured depth. The well path after an initial near vertical section of approximately 304.8 meters (1000 feet) is planned to include a build section where an incline angle build rate of approximately 3.5 degrees per 30.48 meters (100 feet) is maintained until an incline angle of 80.88 degrees is reached at approximately 1009.2 meters (3311 feet) measured depth. The incline angle of approximately 80.88 degrees is to be held until a measured depth of 4572 meters (15,000 feet) is reached. A 9⅝ inch (24.45 cm) nominal diameter casing is planned to extend to 3048 meters (10,000 feet), with an expected friction factor during running of the liner within the casing of 0.35. The expected friction factor in the nominal 21.59 cm (8½ inch) diameter hole extending from 3048 meters (10,000 feet) to 4572 meters (15,000 feet) is 0.50. The planned mud has a density of approximately 1121 kilograms per cubic meter (70 pounds per cubic foot). By using a nominal diameter 6.0325 cm (2⅜ inch), 1.814 kilogram (4 pound) tubing (i.e., conduit 60 shown in FIG. 7) within the liner, a buoyed weight of approximately 24.40 newtons/meter (18.00 pounds/foot) compared to a flotation cavity 12*a* (see FIG. 2) within a liner buoyed weight (without tubing) of 33.69 newtons/meter (24.85 pounds/foot).

A cement retainer on one end, 6.0325 cm (2⅜ inch) nominal diameter tubing string between ends and an inflatable packer on the other end of the liner creates an air annulus cavity 12*b* within the liner. A liner tool and tubing overshot are to be screwed onto the liner and drill pipe is then to be used to run the liner to the bottom. The drill pipe is expected to be filled with mud at every joint and the liner/drill string rotated until it reaches bottom. Once the liner is on bottom, it can be rotated and/or reciprocated while the cement is pumped through the tubing or conduit 60 and back up the liner-hole annulus. Rotary torque for this air annulus embodiment is expected to be reduced significantly when compared to running a liner without a flotation cavity (e.g., a torque of approximately 26,000 foot-pounds or 35,251 newton-meters, which is the maximum torque limit of the drill rig planned to be used, is expected to be required at approximately 12,800 feet or 3,901 meters without an air annulus while only approximately 21,000 foot-pounds or 28,472 newton-meters is expected to be required at that depth with an air annulus). This can be especially important if the expected torque without an air annulus is expected to exceed the maximum torque limit of the drill rig, as in this case, and allows and additional 671 meters (2,200 feet) of liner to be run without exceeding the maximum torque limit.

Still other alternative embodiments are possible. These include: a plurality of float shoe seals and air trapping plug seals (for seal redundancy); a single shear pin shearing at two points (located across a port or passageway and replacing one or more sets of shear pins); a sensor-actuated releasable latch or other releasable device to attach each plug to each passageway (replacing shear pins); placement of cylindrical or otherwise ported solid inserts (e.g., foam) or higher density fluid into the flotation cavity 12 in addition to lower density (flotation) fluids (to improve the control of buoyant forces); combining the float shoe, float collar, and/or the landing collar in a single component; combining centralizing (outward radial) protrusions on the string (to create a string stand off annulus within the well bore) with multiple trapping devices at pipe joints; replacing the float shoe valve with a float type trap or other back-flow preventer; and having translating components, conduits, and piping strings primarily composed of flexible material (to more easily navigate deviated sections and alter buoyant forces). A still further alternative embodiment is to make portions of the devices such as plugs from materials which are dissolvable, thermally degradable or fluid reactive/decomposing (avoiding pressure increments or drilling out procedures). Although no longer required, lubricants can also be used in conjunction with these flotation methods and devices to further control or reduce the running coefficient of friction.

These flotation devices and methods satisfy the need for a simple method to run a casing or liner string in a long horizontal well bore. Portions of the string are "floated" in the well bore fluids by providing one or more plugged buoyant cavities. In one embodiment, opening a circulation and cementing path can be accomplished by a simple increase in pressure and translation of insert/plug devices without entirely removing the devices. This embodiment also allows circulation during buoyant operations and reciprocating/rotation during cementing. Devices are finally removed by normal post-cementing drilling out techniques, avoiding the need for a separate removal step.

The use of air and lightweight materials minimizes storage and other related requirements. The present invention also reduces the maximum capability of the drill rig needed to accomplish the setting of the casing/liner string and extended reach well could theoretically have an infinite length (i.e., total measured depth) if flotation cavity sections are at neutral buoyancy. More typically, the invention provides major advantages for higher than critical incline angle (e.g., nearly horizontal) well portions (to be lined or cased) of at least 914 meters (3,000 feet) in length , more preferably at least 1524 meters (5,000 feet), and still more preferably at least 1828 meters (6,000 feet) in length. The buoyancy forces also allow a high build rate, limited only by the flexibility of the liner or casing tubular members. The buoyant forces can theoretically provide a bending force without scraping (and possibly damaging or excessively opening) the build portion of the wellbore. More typically, the invention provides major advantages for build rates of at least approximately 2.0 degrees per 30.48 meters (100 feet), more preferably a build rate of at least approximately 3.5 degrees per 30.48 meters (100 feet). Further advantages of the device include: increased safety (avoiding large casing running loads at the drilling platform), reliability (reducing the likelihood of stuck casing), maintenance (single use, drillable components), efficiency (full flow production/injection capability), and reduced cost (no separate removal step or need to recover items from great depth).

Flotation devices for and methods of accomplishing drilling and completion of extended reach wells are also disclosed in paper entitled "Extended Reach Drilling From Platform Irene," by M. D. Mueller, J. M. Quintana, and M. J. Bunyak, presented to the 22 Annual Offshore Technology Conference in Houston, Tex., May 7-10, 1990, the teaching of which are incorporated herein by reference.

Still further, a hydraulic release oil tool which may be used advantageously with the present invention is disclosed in U.S. patent application Ser. No. 07/418,510, filed on Oct. 9, 1990, the teachings which are incorporated in their entirety by reference. The release tool may be used to removably attach a drill string to a liner having a flotation cavity and being run into an extended reach wellbore. The release tool allows bidirectional rotation and high torque, combined with ease of release and removal.

Although preferred embodiments of the invention has been shown and described (each embodiment is preferred for different well conditions and applications), and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A process useful in installing a duct segment within an underground hole which contains a first fluid and extends underground from at least a near surface position to at least a shallow underground position, said process comprising:

inserting said duct into said hole, said duct having a flotation chamber containing a second fluid having a density less than said first fluid sufficient to produce a buoyant force on said duct when said duct is immersed in said first fluid, said flotation chamber further comprising:

a fluid restriction device attached to said duct at a downhole end of said flotation chamber;

a fluid trapping insert attached to said duct at an uphole end of said flotation chamber; and wherein said shallow underground position is displaced a vertical distance and a substantial horizontal distance from said near surface position, said horizontal distance being greater than said vertical distance.

2. The process of claim 1 wherein said horizontal distance is substantially greater than said vertical distance.

3. The process of claim 2 wherein said horizontal distance is at least about 6,000 feet.

4. The process of claim 3 wherein said vertical distance is less than 3000 feet.

5. The process of claim 2 wherein said horizontal distance is at least about 12,000 feet.

6. The process of claim 3 wherein said vertical distance is less than 4000 feet.

7. The process of claim 6 wherein said inserting step also comprises rotating and oscillating said duct segment.

8. The process of claim 6 wherein a substantial portion of said fluid-containing hole which said duct is inserted into is at an incline angle of at least about 63.4 degrees.

9. The process of claim 8 wherein said incline angle ranges from about 63.4 to about 78.7 degrees.

10. The process of claim 8 wherein said incline angle is at least about 85.5 degrees.

11. The process of claim 8 wherein said horizontal distance is at least 2.41 miles.

12. A process useful for installing a duct segment within an underground hole, which hole contains a first fluid and extends underground from at least a near surface location to an underground location vertically and horizontally displaced from said near surface location, wherein a first imaginary straight line connecting said locations intersects a vertical line commencing downward from said near surface location to form the vertex of an angle no greater than 90 degrees, said process comprising:

inserting said duct segment into said hole at least to said underground location, said duct having a flotation chamber containing a sufficient amount of second fluid having a density less than said first fluid so as to produce a buoyant force on said duct when said duct is immersed in said first fluid in said underground hole, said flotation chamber further comprising:

a fluid flow restriction device attached to said duct at one end of said flotation chamber;

a fluid trapping insert attached to the other end of said flotation chamber and wherein said angle is at least about 63.4 degrees and said horizontal displacement is substantial.

13. The process of claim 12 wherein said underground location is horizontally displaced a distance of at least about 6,000 feet.

14. The process of claim 12 wherein said underground location is horizontally displaced a distance of at least about 9,000 feet.

15. The process of claim 12 wherein said underground location is horizontally displaced a distance of at least 2.41 miles.

16. The process of claim 15 wherein said underground location is vertically displaced less than 5,000 feet.

17. The process of claim 16 wherein said angle is in the range of about 63.4 to about 78.7 degrees.

18. The process of claim 12 wherein said angle is at least about 85.5 degrees.

19. The process of claim 18 wherein said underground location is vertically displaced less than 5,000 feet.

20. The process of claim 18 wherein said underground location is vertically displaced less than 3,000 feet.

21. The process of claim 14 wherein said first fluid is a drilling mud and said inserting step also comprises rotating said duct segment while circulating said mud.

22. The process of claim 21 wherein said underground location is vertically displaced less than 5,000 feet.

23. The process of claim 21 wherein said underground location is vertically displaced less than 3,000 feet.

24. The process of claim 21 wherein said duct is a liner, said second fluid is air, and said liner is attached to a work string, said process also comprising:

holding said liner in a set position after said liner extends to at least said underground location; and flowing a cement slurry from said near-surface location to said underground location through said liner while said liner is in said set position.

* * * * *